US005671495A

United States Patent [19]

Chen

[11] Patent Number: 5,671,495

[45] Date of Patent: Sep. 30, 1997

[54] RECYCLABLE SHOE MIDSOLE CLOTH AND METHOD OF MAKING SAME

[76] Inventor: H. J. Chen, 5F-3, No. 229, Shuej-Fu Rd., Ta-Ya Hsian, Taichung Hsien, Taiwan

[21] Appl. No.: 490,302

[22] Filed: Jun. 14, 1995

Related U.S. Application Data

[63] Continuation-in-part of Ser. No. 205,410, Mar. 3, 1994, abandoned.

[51] Int. Cl.[6] ..... A43D 29/00

[52] U.S. Cl. ..... 12/146 R; 12/142 G; 36/44; 19/297; 19/145.5; 28/100

[58] Field of Search ..... 19/65 R, 65 A, 19/296, 297, 161.1, 145.5, 145.7, 115 R; 57/1 R; 28/100, 140; 139/1 R, 1 F, 383 R; 12/146 R, 142 G, 142 R; 36/30 R, 30 A, 44; 428/236, 245, 261, 290, 302

[56] References Cited

U.S. PATENT DOCUMENTS

| | | | |
|---|---|---|---|
| 2,391,564 | 12/1945 | Gregg | 36/30 |
| 2,733,523 | 2/1956 | Murray | 36/8.5 |
| 4,819,345 | 4/1989 | Mulcahy et al. | 36/17 R |
| 4,970,039 | 11/1990 | Long | 264/136 |
| 5,155,989 | 10/1992 | Frey et al. | 19/65 A |
| 5,331,801 | 7/1994 | Heifetz | 19/145.5 |
| 5,346,934 | 9/1994 | Chriss | 524/11 |
| 5,425,158 | 6/1995 | Ripley | 19/115 R |
| 5,481,864 | 1/1996 | Wright | 19/145.5 |

OTHER PUBLICATIONS

Grant & Hack's "Chemical Dictionary", 5th Ed., pp. 122 & 331, McGraw–Hill, Inc. Publ.

*Primary Examiner*—Michael A. Neas
*Attorney, Agent, or Firm*—Browdy and Neimark

[57] ABSTRACT

A recyclable shoe midsole cloth is made from a recycled waste fabric material or a recycled rejected fabric product. The recycled material or product is processed such that the threads making up the recycled material or product are rehabilitated to become raw cotton materials, which are then processed to become the recyclable shoe midsole cloth.

10 Claims, 2 Drawing Sheets

RECYCLABLE SHOE MIDSOLE CLOTH AND METHOD OF MAKING SAME

This is a continuation-in-part of parent application Ser. No. 08/205,410, filed Mar. 3, 1994, now abandoned, the contents of which are hereby incorporated by reference.

FIELD OF THE INVENTION

The present invention relates generally to a shoe midsole cloth, and more particularly to a recyclable shoe midsole cloth and a method of making the recyclable shoe midsole cloth.

BACKGROUND OF THE INVENTION

Shoe soles are generally composed of an outsole, midsole and shoe pad. The midsole can take various forms and constructions in view of the fact that it is one of the most important parts of the shoe. In other words, the midsole is a determining factor of the comfortability and durability of the shoe. The shoe midsole is generally made of a cloth material or a paperboard (wood fiber) material which cannot be recycled and which depends on virgin material, i.e. wood fiber obtained from the cutting of timber, thereby reducing the natural resources of timber.

The conventional method of making a shoe midsole cloth has not been streamlined to the extent that the undesirably produced waste is reduced substantially. In addition, the shoe midsole cloth produced by the conventional method is not recyclable and decomposable. In other words, the conventional shoe midsole cloth is a potential environmental pollutant.

SUMMARY OF THE INVENTION

It is therefore a primary objective of the present invention to provide a recyclable shoe midsole cloth and a method of making such recyclable shoe midsole.

The foregoing objective, features and functions of the present invention will be more readily understood upon a thoughtful deliberation of the following detailed description of the present invention in conjunction with the accompanying drawing.

DETAILED DESCRIPTION OF THE INVENTION

Figure 1:
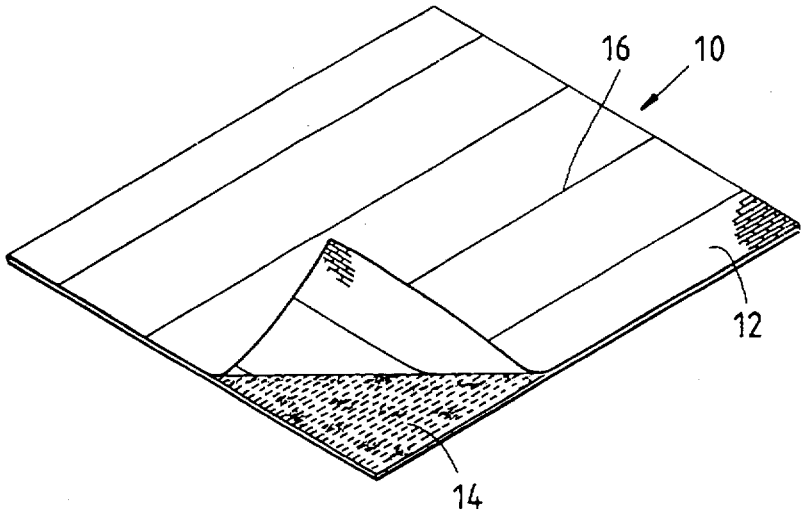
FIG. 1 shows a schematic view of a shoe midsole cloth of the present invention.
Figure 2:
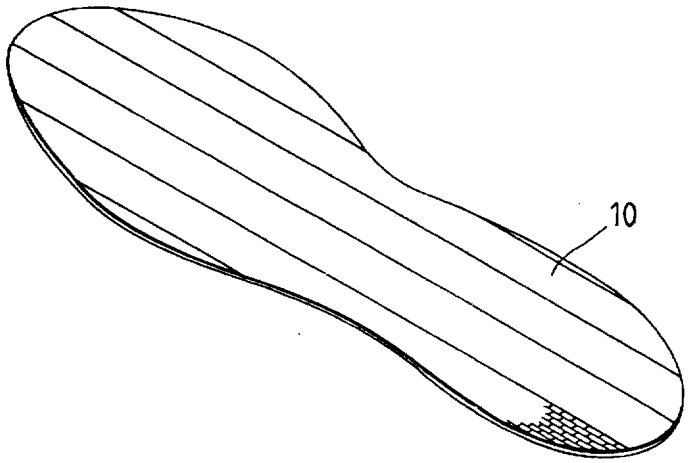
FIG. 2 is a perspective view illustrating the shoe midsole which is made of the shoe midsole cloth of the preferred embodiment of the present invention.
Figure 3:
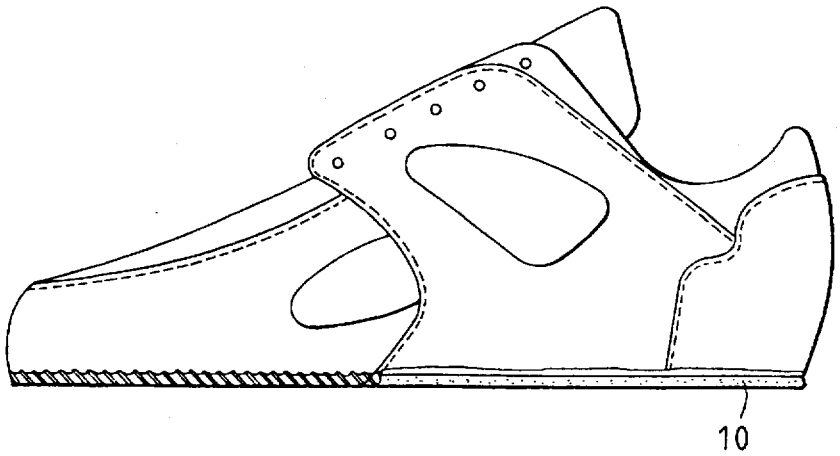
FIG. 3 is an elevational view, partly in section, of a shoe showing the fastening by sewing of the shoe face with the shoe midsole which is made of the shoe midsole cloth of the preferred embodiment of the present invention.
Figure 4:
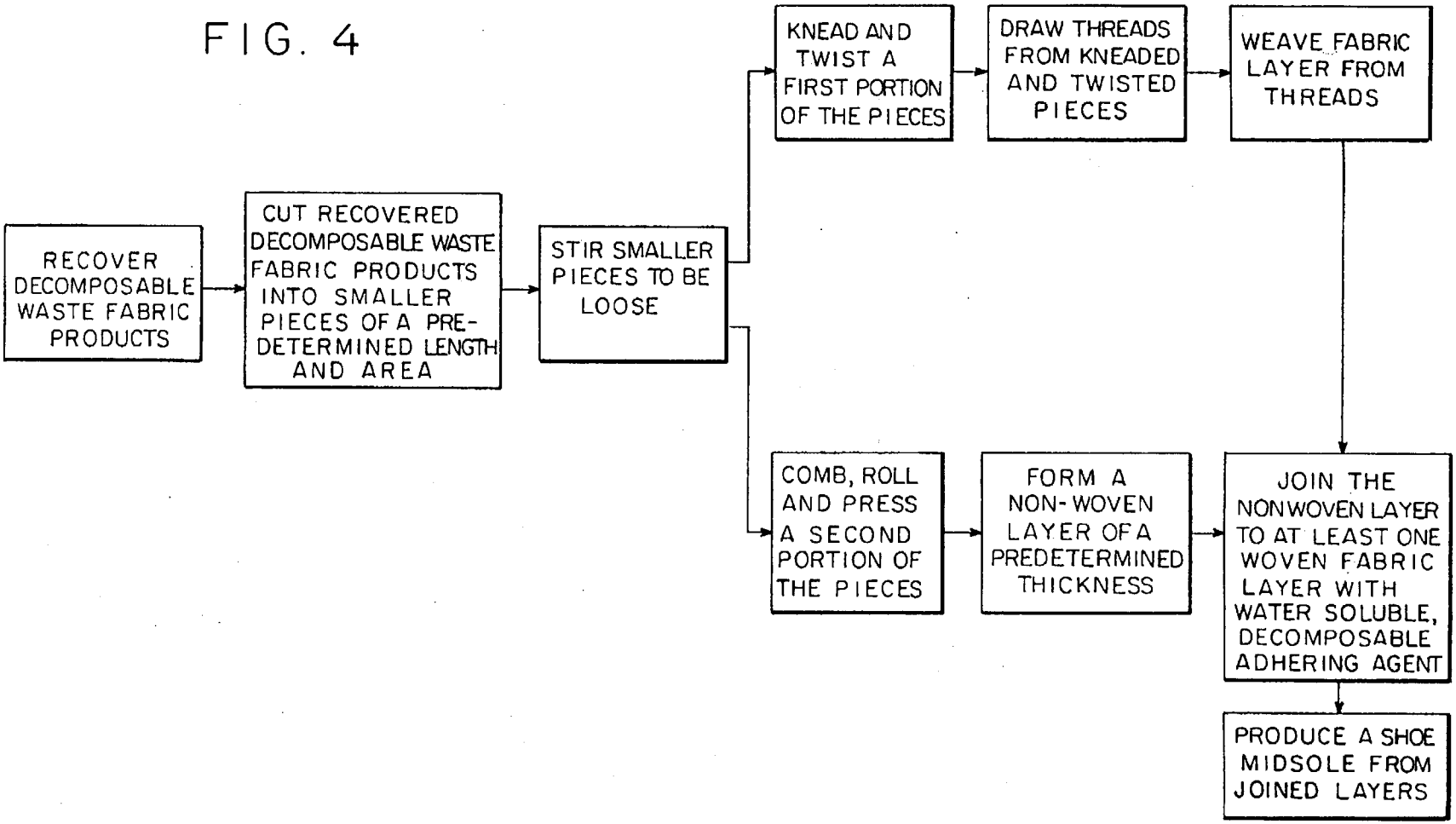
FIG. 4 is a block diagram illustrating the process of the invention.

As shown in FIG. 1, a shoe midsole cloth 10 of the present invention comprises an upper and lower cloth layer 12 and a nonwoven layer 14 sandwiched between the upper and lower cloth layer 12. The nonwoven layer 14 is adhered to the cloth layer 12 by an adhering agent, i.e. a suitable adhesive, preferably of styrene-butadiene rubber (SBR) emulsion as defined in more detail below.

The cloth layer 12 is made from a mixture of waste cotton, waste yarn, waste silk, waste cloth, etc. by drawing, while the nonwoven layer 14 is made from a mixture of waste cotton, waste yarn, waste silk and waste cloth by rolling.

The waste cotton is a waste material produced in the yarn making process. The waste yarn and the waste silk useable in the present invention may be made of a cotton material, a polyester material, or a rayon material. In other words and in contrast with the prior art the present invention makes use of various recycled fibrous materials to make the recyclable shoe midsole cloth.

The sources of the waste yarn and the waste silk include the rejected product of the yarn-dyeing process and the rejected products produced in the yarn-drawing process and the silk-drawing process.

The main sources of the waste cloth include the waste produced in the fabric-cutting process, the fabric-finishing process, the shoe midsole cloth making process, and the fabric making process.

The regeneration process of the recycled materials mentioned above includes a cotton recovering process, a cotton regenerating process, and a cotton finishing process.

The cotton recovering process includes:

(1) recovering the rejected products of yarn and silk production of various types of fibers so that such rejected products become so-called "raw cottons"; and (2) recovering the rejected fabric products of various types and including the following steps:

(i) cutting the waste fabric into small pieces forming in quantity the smaller unit fabric of a predetermined length and area.

(ii) stirring loose the fabric texture of the unit fabric to become individual threads; and (iii) rehabilitating and reconditioning the individual threads to become so-called "raw cottons".

The cotton regenerating process is a process in which a raw material is obtained separately from the waste cotton, the waste yarn, the waste silk, the waste cloth, or from a mixture of the waste cotton, the waste yarn, the waste silk and the waste cloth.

The cotton finishing process includes the following steps of:

(1) drawing the regenerated cotton; kneading and twisting the regenerated cotton fibers to become threads; weaving the threads into a fabric layer.

(2) combining the regenerated raw cotton with a cotton combing machine to form a nonwoven cotton layer of a predetermined thickness.

The fabric layer described above in the step (1) is the cloth layer 12 while the nonwoven cotton layer described above in the step (2) is rolled and pressed to become the nonwoven layer 14 of a predetermined thickness. The nonwoven layer 14 has a thickness that is determined by the number of the layers of the nonwoven cotton layer.

The shoe midsole cloth 10 is made up of the woven cloth layers 12 and the nonwoven layer 14, which are adhered together by a suitable adhering agent. According to the present invention, the adhering agent is preferably water soluble and decomposable in the environment; it is most preferably composed of 40–50% of SBR/acrylic emulsified colloid, 2–5% of a promoting agent, preferably methyl cellulose, 25–30% of a filling material, preferably $CaCO_3$, and 15–33% of water. The filling material, i.e. calcium carbonate powder, is mixed with the water for 3–4 hours before the mixture is combined with another mixture of the SBR/acrylic emulsified colloid, the promoting agent and water, and stirred for about four hours until the mixture becomes a viscous body in which the calcium carbonate particles are evenly distributed so as to enhance the physical property of the viscous body. The SBR adhering agent also desirably contains a small amount of a suitable fungicide, e.g. Dowicide™.

The promoting agent, preferably methyl cellulose, is used to enhance the viscosity of the adhering agent and the holding power between the cloth layer and the nonfabric layer so as to ensure that the yarn of the midsole cloth will not be disengaged when the midsole cloth is cut and to enhance the filling thickness and elasticity.

The SBR adhering agent of the present invention is not a pollutant and is nontoxic to human beings. The adhering agent of the prior art, to the contrary, is an oily colloid and can evaporate during the adhering process, thereby causing an environmental pollution.

The advantages inherent in the present invention are described hereinafter.

The shoe midsole cloth of the present invention does not cause the environmental pollution in view of the fact that the SBR adhering agent is decomposable. In addition, the shoe midsole cloth of the present invention is made from the recycled materials.

The present invention makes use of the waste fabric materials which are otherwise disposed of by various costly methods.

The shoe midsole cloth of the present invention is in itself recyclable, thereby resulting in the reduction in the garbage.

The manufacturing process of the shoe midsole cloth of the present invention does not involve the use of chemicals that are environmental pollutants or toxic substances.

In comparison with the prior art shoe midsole, the present invention has the following advantages:

(1) replacing the paper midsole to save trees; the recycled midsole cloth of the present invention is a concept that can be applied to the shoe making process without cutting lots of trees. The present invention makes use of the discarded and waste fibers of various types including silk, cotton, polyester such as PET, rayon, and so forth, and cloth made therefrom;

(2) highly elastic, excellent breathing capability, water repellent, and excellent moisture-absorbing capability; the midsole of the present invention is moisture-absorbing, wear-resistant, and breathable and can be decomposed and regenerated;

(3) resistant to breakage and rupture;

(4) capable of being cut and sewed easily by a machine;

(5) capable of being fastened to a leather by a sewing machine to reduce the cost of making a shoe and to enhance the structural strength of the shoe midsole; and (6) replacing the shoe pad and suitable for use in making various types of shoes.

There are over ten billion pairs of shoes that are made annually around the world, with the annual production of athletic shoes ranging between one billion pairs and one and a half billion pairs. Assuming that one hundred million pairs of athletic shoes are made of the recyclable shoe midsole cloth and that every 25 pairs of shoes use up one yard of single layer of cloth, a total of twelve million yards can be saved. If the midsole cloth is recycled and reused, more resources can be saved. As a result, there will be no lack of material for making the midsole cloth. The midsole cloth so made is practically applied to midsole layer of the athletic shoes, without differentiation in color. The waste materials of various colors can be used without dyeing. Such recyclable midsole cloth is widely accepted by the consumers.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. The means and materials for carrying out various disclosed functions may take a variety of alternative forms without departing from the invention. It is to be understood that the phraseology or terminology employed herein is for the purpose of description and not of limitation.

What is claimed is:

1. A method of making a recyclable shoe midsole (10) from decomposable waste fabric products comprising the steps of:

recovering decomposable waste fabric products, cutting the decomposable waste fabric products into smaller pieces of a predetermined length and area, stirring the smaller pieces of the decomposable waste fabric products to be loose, drawing threads after kneading and twisting a first portion of stirred smaller pieces of the decomposable waste fabric products;

weaving the threads into a woven fabric layer, combing, rolling and pressing a second portion of the stirred smaller pieces of the decomposable waste fabric products to form a nonwoven layer of a predetermined thickness, joining the nonwoven layer to at least one said woven fabric layer with a water soluble, decomposable adhering agent, and producing a shoe midsole (10) from a joined said nonwoven layer and the at least one said woven fabric layer.

2. The method according to claim 1, wherein one of a pair of said woven fabric layers is respectively joined to an upper and lower side of the nonwoven layer with the water soluble, decomposable adhering agent before producing the shoe midsole from the joined layers.

3. The method according to claim 1, wherein the decomposable waste fabric products are waste cotton, waste yarn or waste silk.

4. The method according to claim 1, wherein the water soluble, decomposable adhering agent is a styrene-butadiene rubber.

5. The method according to claim 3, wherein the waste yarn and the waste silk are made of a cotton material, a polyester material or a rayon material.

6. The method according to claim 1, wherein the adhering agent contains a fungicide.

7. The method according to claim 1, wherein the adhering agent comprises 40–50% styrene-butadiene/rubber acrylic emulsified colloid, 2–5% of a promoting agent, 25–30% of a filling material and 15–33% water.

8. The method according to claim 7, wherein the promoting agent is methyl cellulose.

9. The method according to claim 7, wherein the filling material is calcium carbonate powder mixed with the water for 3–4 hours before being combined with a mixture of the styrene-butadiene rubber acrylic emulsified colloid, the promoting agent and the water.

10. The method according to claim 7, wherein the mixture of the calcium-carbonate powder, the styrene-butadiene rubber, the acrylic emulsified colloid, the promoting agent and the water are stirred for four hours.

* * * * *